United States Patent [19]

Gremillion

[11] 4,263,692

[45] Apr. 28, 1981

[54] SHIPBOARD COMMUNICATIONS PHONE-JACK CLEANER

[76] Inventor: Kenneth P. Gremillion, P.O. Box 329, Pass Christian, Miss. 39571

[21] Appl. No.: 72,889

[22] Filed: Sep. 6, 1979

[51] Int. Cl.[3] ..... A47L 25/00

[52] U.S. Cl. ..... 15/210 R; 15/104.04; 15/104.05; 15/211; 51/206 R

[58] Field of Search ..... 15/104.04, 104.05, 160, 15/209 R, 209 B, 209 C, 209 D, 210 R, 211, 244 R; 51/73 R, 205 R, 206 R

[56] References Cited

U.S. PATENT DOCUMENTS

| | | | |
|---|---|---|---|
| 2,713,693 | 7/1955 | Johnson | 15/210 R X |
| 4,117,566 | 10/1978 | Ward | 15/210 R X |
| 4,120,068 | 10/1978 | Kaczmarek | 15/160 |

*Primary Examiner*—Edward L. Roberts

[57] ABSTRACT

A cleaning implement including a cylindrical member containing a centrally located cylindrical cavity having an abrasive surface. A handle element is attached to the cylinder. The cavital surface is used to clean the connecting post located within the headphone receptacle while the outer surface simultaneously cleans the bottom and sides of same.

1 Claim, 2 Drawing Figures

SHIPBOARD COMMUNICATIONS PHONE-JACK CLEANER

BACKGROUND OF THE INVENTION

This invention relates to a cleaning device and more particularly an implement for use in cleaning headphone receptacles of the type found on U.S. Naval Ships.

Maintaining adequate channels of communications on board a ship especially a war ship is obviously of the utmost importance, indeed it is the most important of all shipboard functions. However, the corrosive nature of the sea air sometimes if not frequently renders the headphone receptacles inoperative or inadequate. Until now the only way to remedy this problem was to manually clean the receptacle with small pieces of sandpaper, etc., which, beyond the fact that this method is tedious and waste of time it is also minimally effective. Furthermore, this method of cleaning is impossible in rough seas or darkness. Accordingly, this invention provides a cleaning implement which can effectively clean headphone receptacles quickly and thoroughly also with the distinct advantage of being operable in rough seas or in darkness.

SUMMARY OF THE INVENTION

In accordance with the invention, the cleaning implement includes a solid cylindrical rigid member containing a centrally located cylindrical cavity.

The entire surface area of the cylindrical member is bonded to a pliable material upon which is bonded an abrasive surface.

A spherical handle with a cylindrical shaft is connected to the main cylindrical body.

BRIEF DESCRIPTION OF DRAWING

Further objects and advantages of the invention will become apparent from the following description and claim, and from the accompanying drawing, wherein:

DETAILED DESCRIPTION OF THE PREFERRED EMBODIMENT

Figure 1:
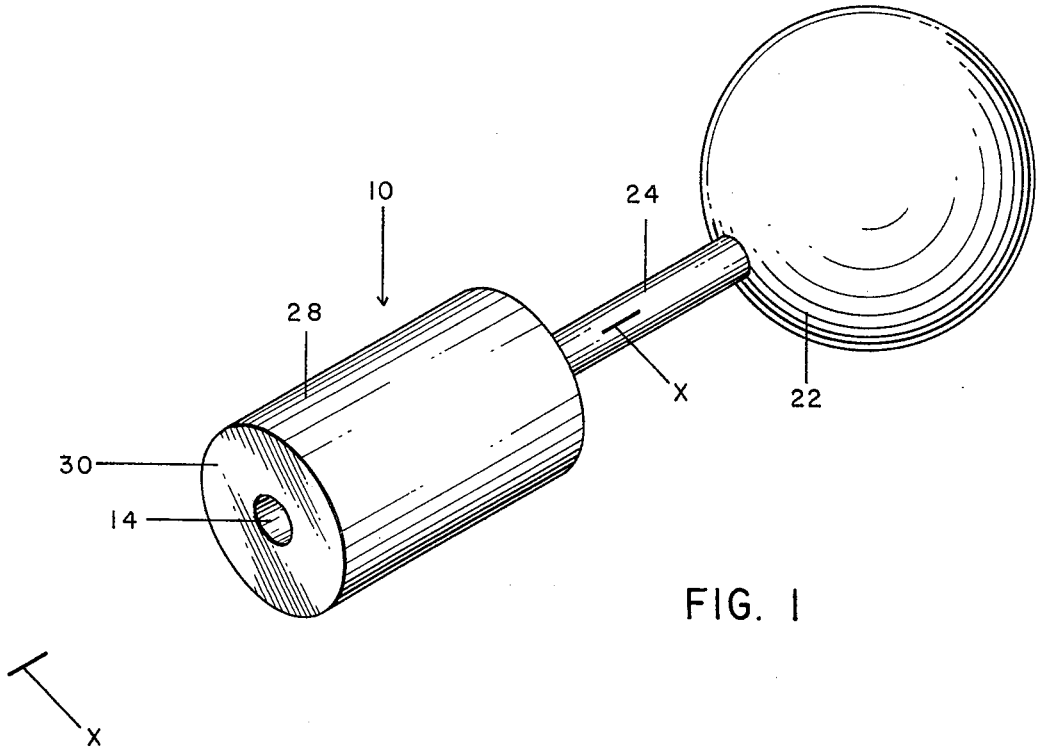
FIG. 1 is a perspective view of the cleaning implement of the present invention.
Figure 2:
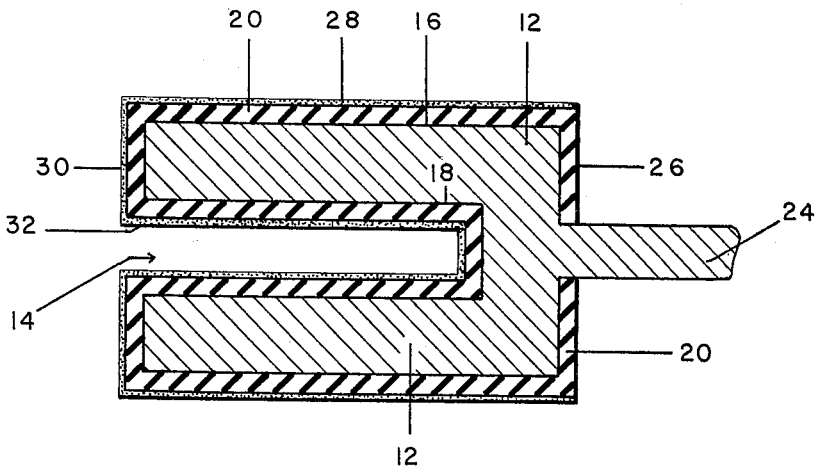
FIG. 2 is a cross-sectional view taken substantially along the plane indicated by line X—X of FIG. 1.

Referring now to the drawing in detail, wherein like numerals refer to like elements throughout the different views, the cleaning implement 10 of the present invention includes a solid member 12 with a centrally located cylindrical cavity 14. The surface 16 of the solid member 12 including the inner cavity 14 walls 18 are bonded to a pliable material 20. A spherical handle 22 with a connecting shaft 24 is attached to the distal end 26 of the cylinder 12. An abrasive surface 28 is bonded to the pliable material 20 on the side of the cylinder 12 and an abrasive surface 30 is bonded to the pliable covering 20 on the front of the cylinder 12 and an abrasive surface 32 is bonded to the pliable material 20 inside the cylinder 12 cavity 14.

In use, the cylinder 12 is inserted into the headphone receptacle and rotated briskly, the outer abrasive surface 28 cleans the wall of the receptacle while the front abrasive surface 30 and the inner cavity 14 surface 32 simultaneously clean the floor and connecting post of the receptacle respectively.

While a specific embodiment of a headphone receptacle cleaning implement has been disclosed in the foregoing description, it will be understood that various modifications within the spirit of the invention may occur to those skilled in the art. Therefore it is intended that no limitations be placed on the invention except as defined by the scope of the appended claims.

I claim:

1. a cleaning implement for cleaning the interior surfaces of headphone receptacles comprising:
   - a generally solid cylinder with a centrally located cylindrical cavity,
   - a layer of pliable material bonded to and covering the surface areas of the cylinder,
   - an abrasive surface bonded to the pliable covering,
   - a spherical handle connected to the main cylinder body by a cylindrical shaft.

* * * * *